US009887021B2

(12) United States Patent
Li et al.

(10) Patent No.: US 9,887,021 B2
(45) Date of Patent: Feb. 6, 2018

(54) TENSILE CONDUCTING MONOFILAMENT AND CONDUCTING WIRE AND MANUFACTURING METHOD THEREOF

(71) Applicant: Dongguan City Huayang Lighting Co., Ltd., Dongguan (CN)

(72) Inventors: Zhao-Yuan Li, Dongguan (CN); Ben-Yi Yao, Xinyang (CN)

(73) Assignee: DONGGUAN CITY HUAYANG LIGHTING CO., LTD., Dongguan (CN)

( * ) Notice: Subject to any disclaimer, the term of this patent is extended or adjusted under 35 U.S.C. 154(b) by 0 days.

(21) Appl. No.: 15/085,818

(22) Filed: Mar. 30, 2016

(65) Prior Publication Data

US 2017/0236615 A1 Aug. 17, 2017

(30) Foreign Application Priority Data

Feb. 17, 2016 (CN) ..... 2016 1 0089916

(51) Int. Cl.
*H01B 7/00* (2006.01)
*H01B 13/02* (2006.01)

(52) U.S. Cl.
CPC ..... *H01B 7/0009* (2013.01); *H01B 13/02* (2013.01)

(58) Field of Classification Search
CPC ..... H01R 13/035
USPC ..... 174/108, 113 C, 126.4
See application file for complete search history.

(56) References Cited

U.S. PATENT DOCUMENTS 2,458,243 A * 1/1949 Biddle ..... C03C 25/46 174/131 A
3,037,068 A * 5/1962 Wessel ..... H01B 7/065 174/113 C
4,090,763 A * 5/1978 Congdon ..... B29C 47/02 174/113 C
4,907,852 A * 3/1990 Noba ..... B29C 33/123 385/58
5,516,986 A * 5/1996 Peterson ..... H01B 7/0009 174/108
5,843,031 A * 12/1998 Hermann ..... A61B 17/12036 604/200

(Continued)

*Primary Examiner* — Chau N Nguyen
(74) *Attorney, Agent, or Firm* — Ming Chow; Sinorica, LLC

(57) ABSTRACT

The present disclosure relates to a tensile conducting monofilament and a conducting wire and a manufacturing method thereof. The tensile conducting monofilament is composed of a conducting filament and at least one tensile thread. The conducting filament is a flat conducting filament. The flat conducting filament is wound on the tensile thread. The conducting wire includes a circular conducting monofilament, at least one tensile conducting monofilament, and an insulation cover. The tensile conducting monofilament and the circular conducting monofilament are wrapped in the insulation cover. The method to manufacture a tensile conducting monofilament includes the steps of flattening a circular conducting monofilament to a flat conducting filament; and winding the flat conducting filament on at least one tensile thread. The method to manufacture a conducting wire includes the steps of stranding the tensile conducting monofilament and a circular conducting monofilament to be disposed in an insulation cover.

4 Claims, 3 Drawing Sheets

(56) References Cited

U.S. PATENT DOCUMENTS

| | | | | |
|---|---|---|---|---|
| 6,894,226 | B2 * | 5/2005 | Yokoi | H01B 11/183 174/102 R |
| 7,170,008 | B2 * | 1/2007 | Victor | H01B 11/12 174/110 R |
| 7,288,494 | B2 * | 10/2007 | Iwasaki | H05K 9/0098 139/425 R |
| 2003/0024730 | A1 * | 2/2003 | Otto | H01L 39/143 174/125.1 |

* cited by examiner

TENSILE CONDUCTING MONOFILAMENT AND CONDUCTING WIRE AND MANUFACTURING METHOD THEREOF

The current application claims a foreign priority to application number 201610089916.8 filed on Feb. 17, 2016 in China.

FIELD

The present disclosure relates to an illumination wire, and more particularly to a tensile conducting monofilament, a conducting wire, and a manufacturing method thereof for an illumination wire.

BACKGROUND

Electric wires used for illumination or decorative string lights must have a certain tensile strength because the wires are provided with decorations. Preferably, they should meet the requirements of U.S. UL 588 for the tensile strength of conducting wires. In general, a conducting wire is composed of a conducting core wire and an insulation cover to wrap the conducting core is wire. A conducting core wire used for string lights may be composed of sixteen conducting monofilaments (bare copper wires) which are stranded together.

In the prior art, the number of the tensile threads are increased to improve the tensile strength of the conducting wire. One way to increase the tensile threads is that the tensile threads and the conducting core wire composed of multiple metal monofilaments are disposed in an insulation cover. Another way is that the tensile threads are directly stranded with the conducting core wire. The way to strand the tensile thread and the conducting core wire is that the tensile thread and the multiple conducting monofilaments of the conducting core wire are stranded together, or the multiple conducting monofilaments are wound on the tensile thread for directly connecting with the conducting wire of a decoration light. A layer or multiple layers of multiple conducting monofilaments are formed on the tensile thread.

However, the conducting wire that the tensile threads and the conducting core wire composed of multiple monofilaments are disposed in an insulation cover has some shortcomings. First, the production efficiency of this conducting wire is less 30% than that of a normal conducting wire. Secondly, during production, the tensile thread may wrap the conducting core wire to bring a non-conducting phenomenon. Thirdly, the multiple tensile threads may scatter and won't be connected with the contact terminals of the lamp socket, without providing the tensile effect. Fourthly, the conducting wire is too hard, which influences the production efficiency of string lights.

The stranding procedure of the tensile thread and the conducting core wire may influence the conductivity of the conducting core wire. In general, the conducting core wire is first stranded and then annealed, such that the diameter of the conducting core wire won't change so as to ensure the resistance of the conducting core wire and the safety of the electric wire. But, the conducting core wire is first annealed and then stranded with the tensile is thread. This cannot ensure the size of the conducting core wire and the demand for the resistance of the conductor. Accordingly, the inventor of the present disclosure has devoted himself based on his many years of practical experiences to solve these problems.

SUMMARY

The present disclosure is to provide a tensile conducting monofilament and a conducting wire manufactured by using the tensile conducting monofilament. The tensile conducting monofilament has greater tensile strength. The conducing wire meets the standard of U.S. UL588.

In order to achieve the aforesaid object, the tensile conducting monofilament of the present disclosure comprises a conducting filament and at least one tensile thread. The conducting filament is a flat conducting filament. The flat conducting filament is wound on the tensile thread.

Preferably, the flat conducting filament is spirally wound on the tensile thread or the flat conducting filament is coiled to form a cylinder. The tensile thread is disposed in the cylinder of the flat conducting filament.

Preferably, when the flat conducting filament is spirally wound on the tensile thread, the flat conducting filament wraps the tensile thread fully, and the tensile thread won't be seen from the appearance.

Preferably, the flat conducting filament is wound on the tensile thread about 15-20 laps per 1 cm.

Preferably, the flat conducting filament has a thickness of 0.06-0.08 mm and a width of 0.4-0.5 mm.

Preferably, the flat conducting filament has a thickness of 0.07 mm and a width of 0.35 mm.

Preferably, the tensile thread is one of a nylon thread, a synthetic fiber thread, and a PVC (polyvinyl chloride) thread.

Preferably, the tensile thread has a diameter of 0.2-0.3 mm.

Preferably, the tensile thread has a tensile strength of not less than 5 kilograms.

The present disclosure further provides a conducting wire. The conducting wire comprises a circular conducting monofilament, at least one tensile conducting monofilament, and an insulation cover. The at least one tensile conducting monofilament and the circular conducting monofilament are wrapped in the insulation cover. The tensile conducting monofilament is the aforesaid tensile conducting monofilament. The circular conducting monofilament is a normal conducting wire, which is a bare metal wire.

Preferably, the circular conducting monofilament is a copper wire.

Preferably, the conducting wire is composed of the at least one tensile conducting monofilament and 13-15 circular conducting monofilaments which are stranded together.

Preferably, the at least one tensile conducting monofilament and 13-15 circular conducting monofilaments are stranded with a lay length of 0.6-0.7 cm.

The present disclosure further provides a method to manufacture a tensile conducting monofilament. The method comprises the following steps of:

step 1: a circular conducting monofilament being flattened to a flat conducting filament;

step 2: the flat conducting filament being wound on at least one tensile thread.

Preferably, the flat conducting filament is wound on the tensile thread, or the flat conducting filament is coiled to form a cylinder and the tensile thread is disposed in the cylinder of the flat conducting filament.

Preferably, the tensile conducting monofilament has a diameter of 0.45-0.5 mm.

Preferably, the tensile conducting monofilament formed by the flat conducting filament to wind on the tensile thread or formed by coiling the flat conducting filament has a diameter of 0.45-0.5 mm.

The present disclosure further provides a method to manufacture a conducting wire. The method comprises the following steps of:

step 1: manufacturing a tensile conducting monofilament according to the aforesaid method;

step 2: stranding at least one tensile conducting monofilament and a circular conducting monofilament to be disposed in an insulation cover. The method for the tensile conducting monofilament and the circular conducting monofilament to be wrapped in the insulation cover is the prior art and won't be described hereinafter.

Preferably, the at least one tensile conducting monofilament and 13-15 circular conducting monofilaments are stranded with a lay length of 0.6-0.7 cm.

The beneficial effects of the present disclosure are described hereinafter. First, because the tensile conducting monofilament is manufactured separately, the tensile conducting monofilament and the other circular conducting monofilaments of the conducting wire can be manufactured synchronously, not influencing the production efficiency. Secondly, the tensile thread is fully wrapped and stranded with the flat conducting filament, which won't change the follow-up manufacturing technology of the conducting wire. There is no need to modify the equipment. Therefore, it won't influence the production efficiency of the follow-up manufacturing technology. Thirdly, the appearance of the tensile conducting monofilament is a conducting wire. After the tensile conducting monofilament and the other circular conducting monofilaments are stranded, the resistance of the conducting wire won't be influenced. But, its tensile strength is enhanced greatly. The minimum of the tensile strength is 26 kilograms, meeting the safety requirement of U.S. UL, 24 KG. Fourthly, the tensile conducting monofilament is a conducting wire. The hardness of the conducting wire having the tensile conducting monofilament is appropriate so as to ensure the production efficiency of the installation of string lights.

DETAILED DESCRIPTION OF THE PREFERRED EMBODIMENTS

Embodiments of the present disclosure will now be described, by way of example only, with reference to the accompanying drawings.

Figure 1:
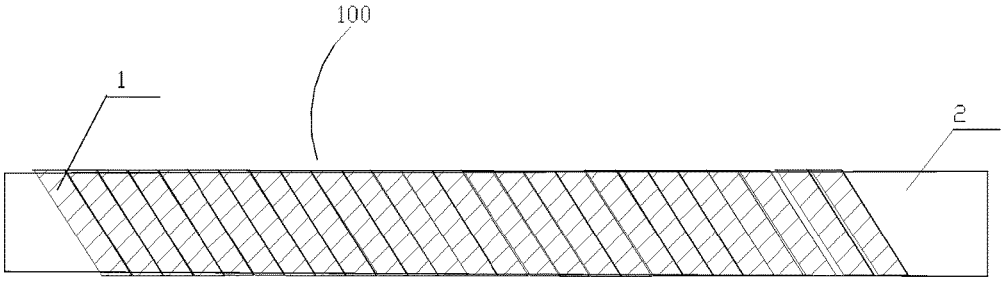
FIG. 1 is a schematic view showing the structure of the tensile conducting monofilament according to a first embodiment of the present disclosure.

As shown in FIG. 1, a tensile conducting monofilament 100 according to a first embodiment of the present disclosure is composed of a flat conducting filament 1 and at least one tensile thread 2. There are three tensile threads in this embodiment. As shown in the drawing, the three tensile threads become one-piece. The flat conducting filament 1 is wound on the tensile thread 2 in a winding manner by means of a high-speed lapping machine. (The winding way of the flat conducting filament 1 in the drawing is only illustrative. In order to show the tensile thread and the flat conducting filament, the tensile thread is not fully wound by the flat conducting filament.) The flat conducting filament is wound on the tensile thread about 15-20 laps per 1 cm.

The flat conducting filament has a thickness of 0.06 mm and a width of 0.4 mm. The flat conducting filament is formed by flattening a circular conducting filament through a calendar.

The tensile thread is a nylon thread.

The tensile thread has a diameter of 0.2 mm.

The tensile thread has a tensile strength of not less than 5 kilograms.

Figure 3:
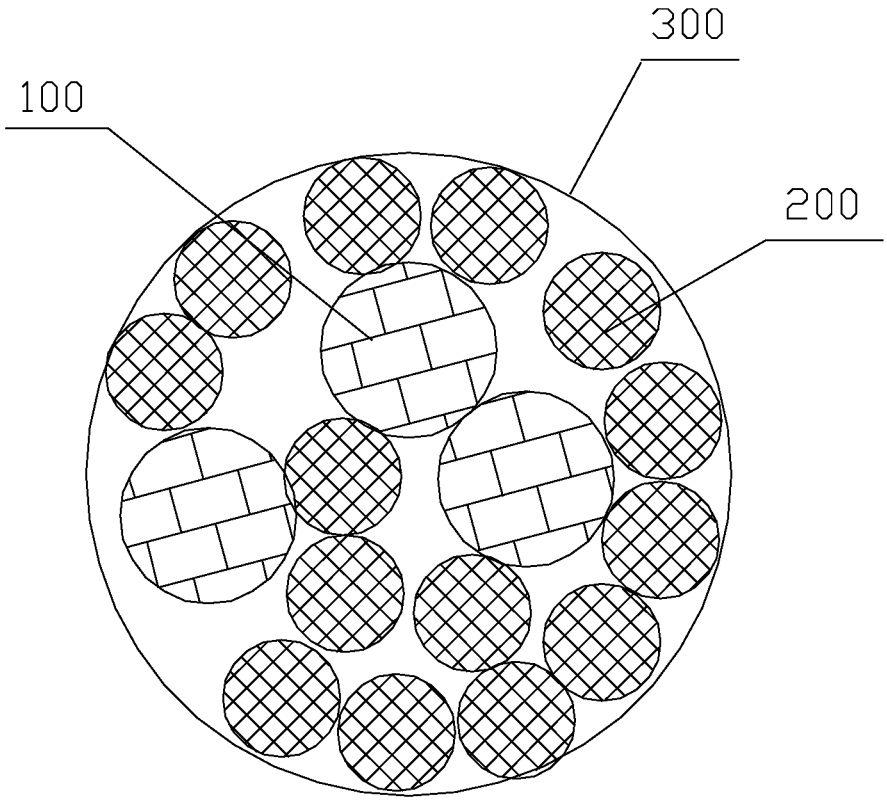
FIG. 3 is a cross-sectional view of the conducting wire.

At least one tensile conducting monofilament 100 and thirteen circular conducting monofilaments 200 are stranded together and disposed in an insulation cover 300. There are three tensile conducting monofilaments 100 in this embodiment. As shown in FIG. 3, the circular conducting monofilaments 200 are copper wires. The flat conducting filament 1 is formed by flattening the circular conducting monofilaments.

A second embodiment is substantially similar to the first embodiment with the exceptions described hereinafter. The flat conducting filament has a thickness of 0.07 mm and a width of 0.35 mm. The tensile thread is a synthetic fiber thread. The tensile thread has a diameter of 0.25 mm. Three tensile conducting monofilaments 100 and thirteen circular conducting monofilaments 200 are stranded with a lay length of 0.6 cm.

Figure 2:
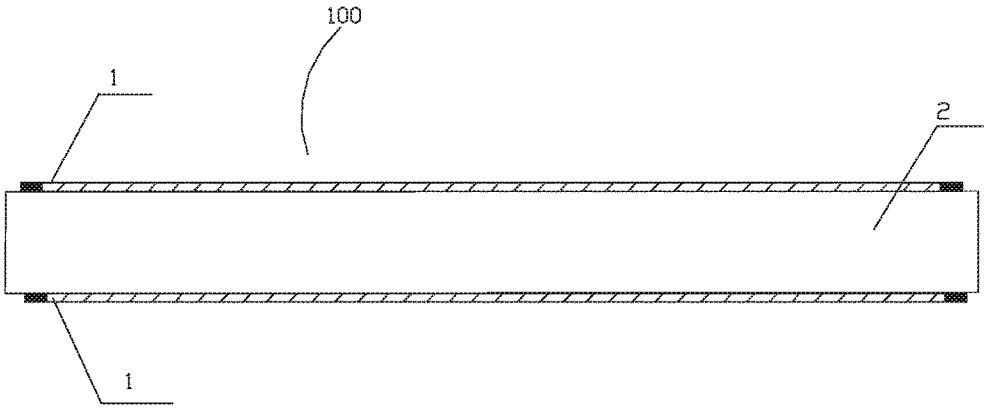
FIG. 2 is a schematic view showing the structure of the tensile conducting monofilament according to a third embodiment of the present disclosure.

As shown in FIG. 2, a tensile conducting monofilament 100 according to a third embodiment of the present disclosure is composed of a flat conducting filament 1 and at least one tensile thread 2. There are four tensile threads in this embodiment. As shown in the drawing, the four tensile threads become one-piece. The flat conducting filament 1 is coiled to form a cylinder so as to sleeve on the tensile thread 2. The axial opening of the cylinder can be sealed or not. (The tensile thread and the flat conducting filament in the drawing are only illustrative. The thickness of the flat conducting filament and the diameter of the tensile thread are subject to the following values.)

The flat conducting filament has a thickness of 0.08 mm and a width of 0.5 mm.

The tensile thread is a PVC (polyvinyl chloride) thread.

The tensile thread has a diameter of 0.3 mm.

The tensile thread has a tensile strength of not less than 5 kilograms.

Two tensile conducting monofilaments 100 and fifteen circular conducting monofilaments 200 are stranded together and disposed in an insulation cover 300 (not shown in the drawing).

The circular conducting monofilaments 200 are copper wires. The flat conducting filament 1 is formed by flattening the circular conducting monofilaments.

The aforesaid embodiments show and describe the basic principle and main feature and advantages of the present disclosure. Although particular embodiments of the present invention have been described in detail for purposes of illustration, various modifications and enhancements may be made without departing from the spirit and scope of the present disclosure. Accordingly, the present disclosure is not to be limited except as by the appended claims.

What is claimed is:

1. A tensile conducting monofilament comprising:

a conducting filament;

a tensile thread;

the conducting filament being a flat conducting filament;

the flat conducting filament being wound on the tensile thread;

the flat conducting filament being coiled to form a cylinder;

the tensile thread being disposed within the cylinder;

the cylinder comprising an axial opening;

the axial opening being sealed;

the flat conducting filament comprising a thickness of 0.06-0.08 mm and a width of 0.4-0.5 mm;

the tensile thread being one of a nylon thread, a synthetic fiber thread, and a PVC (polyvinyl chloride) thread;

the tensile thread comprising a diameter of 0.2-0.3 mm;

the tensile thread comprising a tensile strength of not less than 5 kilograms; and the tensile conducting monofilament comprising a diameter of 0.45-0.5 mm.

2. A conducting wire comprising:

a circular conducting monofilament;

a tensile conducting monofilament;

an insulation cover;

the tensile conducting monofilament and the circular conducting monofilament being wrapped in the insulation cover;

the tensile conducting monofilament being as claimed in claim 1; and the tensile conducting monofilament and the circular conducting monofilament being stranded with a lay length of 0.6-0.7 cm.

3. A method to manufacture a tensile conducting monofilament comprising:

providing a circular conducting filament;

flattening the circular conducting filament to form a flat conducting filament;

providing a tensile thread;

winding the flat conducting filament on the tensile thread;

coiling the flat conducting filament to form a cylinder;

disposing the tensile thread within the cylinder;

forming an axial opening on the cylinder;

sealing the axial opening;

the flat conducting filament comprising a thickness of 0.06-0.08 mm and a width of 0.4-0.5 mm;

the tensile thread being one of a nylon thread, a synthetic fiber thread, and a PVC (polyvinyl chloride) thread;

the tensile thread comprising a diameter of 0.2-0.3 mm;

the tensile thread comprising a tensile strength of not less than 5 kilograms; and the tensile conducting monofilament comprising a diameter of 0.45-0.5 mm.

4. A method to manufacture a conducting wire comprising:

manufacturing a tensile conducting monofilament according to the method as claimed in claim 3;

providing a circular conducting monofilament and an insulation cover;

stranding the tensile conducting monofilament and the circular conducting monofilament to be disposed in the insulation cover; and the tensile conducting monofilament and the circular conducting monofilament are stranded with a lay length of 0.6-0.7 cm.

* * * * *